US006357688B1

(12) United States Patent
Backlund et al.

(10) Patent No.: US 6,357,688 B1
(45) Date of Patent: Mar. 19, 2002

(54) COILING DEVICE

(75) Inventors: Alberti Backlund, Hallstahammar; Mats Leijon, Vasteras, both of (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/355,855

(22) PCT Filed: Feb. 2, 1998

(86) PCT No.: PCT/SE98/00173

§ 371 Date: Nov. 1, 1999

§ 102(e) Date: Nov. 1, 1999

(87) PCT Pub. No.: WO98/33736

PCT Pub. Date: Aug. 6, 1998

(30) Foreign Application Priority Data

Feb. 3, 1997 (SE) ..... 9700366

(51) Int. Cl.[7] ..... B21F 3/04; B65H 54/00; B65H 81/06

(52) U.S. Cl. ..... 242/430; 226/25; 226/43; 242/431; 242/432

(58) Field of Search ..... 242/361, 534, 242/533, 430, 432; 226/25, 43

(56) References Cited

U.S. PATENT DOCUMENTS

| | | |
|---|---|---|
| 681,800 A | 9/1901 | Lasche |
| 847,008 A | 3/1907 | Kitsee |

(List continued on next page.)

FOREIGN PATENT DOCUMENTS

| | | |
|---|---|---|
| AT | 399790 | 7/1995 |
| BE | 565063 | 2/1957 |
| CH | 391071 | 4/1965 |
| CH | 266037 | 10/1965 |
| CH | 534448 | 2/1973 |
| CH | 539328 | 7/1973 |
| CH | 646403 | 2/1979 |
| CH | 657482 | 8/1986 |
| CH | 1189322 | 10/1986 |
| DE | 40414 | 8/1887 |
| DE | 134022 | 12/1901 |
| DE | 277012 | 7/1914 |

(List continued on next page.)

OTHER PUBLICATIONS

A test installation of a self–tuned ac filter in the Konti–Skan 2 HVDC link; T. Holmgren, G. Asplund, S. Valdemarsson, P. Hidman of ABB; U. Jonsson of Svenska Kraftnat; O. loof of Vattenfall Vastsverige AB; IEEE Stockholm Power Tech Conference Jun. 1995, pp. 64–70.

(List continued on next page.)

*Primary Examiner*—Elvin Enad
(74) *Attorney, Agent, or Firm*—Oblon, Spivak, McClelland, Maier & Neustadt, P.C.

(57) ABSTRACT

A device for coiling and uncoiling elongated goods (K), such as wire, cable or the like, onto a drum (13) comprises a support (12) with driving means (25) for a spreader arm (10). The spreader arm (10) is rotatably mounted on the support (12) and supports a gripping arm (14) for coiling and uncoiling the elongated goods (K) onto the stationary drum (13). The gripping arm (14) is formed as a curved V-profile having a running track arranged for the elongated goods (K), which running track is oriented towards the drum (13). The said running track is defined by feeding rollers mounted within the gripping arm (14). The feeding rollers are spherical in shape and have a rolling resistance near zero to eliminate twisting of the elongated goods (K) during coiling and uncoiling. The device also comprises a lifting and rotating table (15) provided under the drum (13) for making possible 180° rotation of the drum (13), which has a coupling (16, 27) to the support (12) detachably arranged during lifting of the drum (13).

14 Claims, 4 Drawing Sheets

U.S. PATENT DOCUMENTS

| | | | | |
|---|---|---|---|---|
| 1,304,451 | A | | 5/1919 | Burnham |
| 1,418,856 | A | | 6/1922 | Williamson |
| 1,481,585 | A | | 1/1924 | Beard |
| 1,508,456 | A | | 9/1924 | Lenz |
| 1,728,915 | A | | 9/1929 | Blankenship et al. |
| 1,742,985 | A | | 1/1930 | Burnham |
| 1,747,507 | A | | 2/1930 | George |
| 1,756,672 | A | | 4/1930 | Barr |
| 1,762,775 | A | | 6/1930 | Ganz |
| 1,781,308 | A | | 11/1930 | Vos |
| 1,861,182 | A | | 5/1932 | Hendey et al. |
| 1,904,885 | A | | 4/1933 | Seeley |
| 1,974,406 | A | | 9/1934 | Apple et al. |
| 2,006,170 | A | | 6/1935 | Juhlin |
| 2,206,856 | A | | 7/1940 | Shearer |
| 2,217,430 | A | | 10/1940 | Baudry |
| 2,241,832 | A | | 5/1941 | Wahlquist |
| 2,251,291 | A | | 8/1941 | Reichelt |
| 2,256,897 | A | | 9/1941 | Davidson et al. |
| 2,295,415 | A | | 9/1942 | Monroe |
| 2,409,893 | A | | 10/1946 | Pendleton et al. |
| 2,415,652 | A | | 2/1947 | Norton |
| 2,424,443 | A | | 7/1947 | Evans |
| 2,436,306 | A | | 2/1948 | Johnson |
| 2,446,999 | A | | 8/1948 | Camilli |
| 2,459,322 | A | | 1/1949 | Johnston |
| 2,462,651 | A | | 2/1949 | Lord |
| 2,498,238 | A | | 2/1950 | Berberich et al. |
| 2,650,350 | A | | 8/1953 | Heath |
| 2,721,905 | A | | 10/1955 | Monroe |
| 2,749,456 | A | | 6/1956 | Luenberger |
| 2,780,771 | A | | 2/1957 | Lee |
| 2,846,599 | A | | 8/1958 | McAdam |
| 2,885,581 | A | | 5/1959 | Pileggi |
| 2,943,242 | A | | 6/1960 | Schaschl et al. |
| 2,947,957 | A | | 8/1960 | Spindler |
| 2,959,699 | A | | 11/1960 | Smith et al. |
| 2,962,679 | A | | 11/1960 | Stratton |
| 2,975,309 | A | | 3/1961 | Seidner |
| 3,014,139 | A | | 12/1961 | Shildneck |
| 3,098,893 | A | | 7/1963 | Pringle et al. |
| 3,130,335 | A | | 4/1964 | Rejda |
| 3,143,269 | A | | 8/1964 | Van Eldik |
| 3,157,806 | A | | 11/1964 | Wiedemann |
| 3,158,770 | A | | 11/1964 | Coggeshall et al. |
| 3,197,723 | A | | 7/1965 | Dortort |
| 3,268,766 | A | | 8/1966 | Amos |
| 3,304,599 | A | | 2/1967 | Nordin |
| 3,354,331 | A | | 11/1967 | Broeker et al. |
| 3,365,657 | A | | 1/1968 | Webb |
| 3,372,283 | A | | 3/1968 | Jaecklin |
| 3,392,779 | A | | 7/1968 | Tilbrook |
| 3,411,027 | A | | 11/1968 | Rosenberg |
| 3,418,530 | A | | 12/1968 | Cheever |
| 3,435,262 | A | | 3/1969 | Bennett et al. |
| 3,437,858 | A | | 4/1969 | White |
| 3,444,407 | A | | 5/1969 | Yates |
| 3,447,002 | A | | 5/1969 | Ronnevig |
| 3,484,690 | A | | 12/1969 | Wald |
| 3,541,221 | A | | 11/1970 | Aupoix et al. |
| 3,560,777 | A | | 2/1971 | Moeller |
| 3,571,690 | A | | 3/1971 | Lataisa |
| 3,593,123 | A | | 7/1971 | Williamson |
| 3,631,519 | A | | 12/1971 | Salahshourian |
| 3,644,662 | A | | 2/1972 | Salahshourian |
| 3,651,244 | A | | 3/1972 | Silver et al. |
| 3,651,402 | A | | 3/1972 | Leffmann |
| 3,660,721 | A | | 5/1972 | Baird |
| 3,666,876 | A | | 5/1972 | Forster |
| 3,670,192 | A | | 6/1972 | Andersson et al. |
| 3,675,056 | A | | 7/1972 | Lenz |
| 3,684,821 | A | | 8/1972 | Miyauchi et al. |
| 3,684,906 | A | | 8/1972 | Lexz |
| 3,685,759 | A | * | 8/1972 | Adams et al. ..... 242/78 |
| 3,699,238 | A | | 10/1972 | Hansen et al. |
| 3,716,652 | A | | 2/1973 | Lusk et al. |
| 3,716,719 | A | | 2/1973 | Angelery et al. |
| 3,727,085 | A | | 4/1973 | Goetz et al. |
| 3,740,600 | A | | 6/1973 | Turley |
| 3,743,867 | A | | 7/1973 | Smith, Jr. |
| 3,746,954 | A | | 7/1973 | Myles et al. |
| 3,758,699 | A | | 9/1973 | Lusk et al. |
| 3,778,891 | A | | 12/1973 | Amasino et al. |
| 3,781,739 | A | | 12/1973 | Meyer |
| 3,787,607 | A | | 1/1974 | Schlafly |
| 3,792,399 | A | | 2/1974 | McLyman |
| 3,801,843 | A | | 4/1974 | Corman et al. |
| 3,809,933 | A | | 5/1974 | Sugawara et al. |
| 3,813,764 | A | | 6/1974 | Tanaka et al. |
| 3,828,115 | A | | 8/1974 | Hvizd, Jr. |
| 3,881,647 | A | | 5/1975 | Wolfe |
| 3,884,154 | A | | 5/1975 | Marten |
| 3,891,880 | A | | 6/1975 | Britsch |
| 3,902,000 | A | | 8/1975 | Forsyth et al. |
| 3,912,957 | A | | 10/1975 | Reynolds |
| 3,932,779 | A | | 1/1976 | Madsen |
| 3,932,791 | A | | 1/1976 | Oswald |
| 3,943,392 | A | | 3/1976 | Keuper et al. |
| 3,947,278 | A | | 3/1976 | Youtsey |
| 3,965,408 | A | | 6/1976 | Higuchi et al. |
| 3,968,388 | A | | 7/1976 | Lambrecht et al. |
| 3,971,543 | A | | 7/1976 | Shanahan |
| 3,974,314 | A | | 8/1976 | Fuchs |
| 3,993,860 | A | | 11/1976 | Snow et al. |
| 3,995,785 | A | | 12/1976 | Arick et al. |
| 4,001,616 | A | | 1/1977 | Lonseth et al. |
| 4,008,367 | A | | 2/1977 | Sunderhauf |
| 4,008,409 | A | | 2/1977 | Rhudy et al. |
| 4,031,310 | A | | 6/1977 | Jachimowicz |
| 4,039,740 | A | | 8/1977 | Iwata |
| 4,041,431 | A | | 8/1977 | Enoksen |
| 4,047,138 | A | | 9/1977 | Steigerwald |
| 4,064,419 | A | | 12/1977 | Peterson |
| 4,084,307 | A | | 4/1978 | Schultz et al. |
| 4,085,347 | A | | 4/1978 | Lichius |
| 4,088,953 | A | | 5/1978 | Sarian |
| 4,091,138 | A | | 5/1978 | Takagi et al. |
| 4,091,139 | A | | 5/1978 | Quirk |
| 4,099,227 | A | | 7/1978 | Liptak |
| 4,103,075 | A | | 7/1978 | Adam |
| 4,106,069 | A | | 8/1978 | Trautner et al. |
| 4,107,092 | A | | 8/1978 | Carnahan et al. |
| 4,109,098 | A | | 8/1978 | Olsson et al. |
| 4,121,148 | A | | 10/1978 | Platzer |
| 4,132,914 | A | | 1/1979 | Khutoretsky |
| 4,134,036 | A | | 1/1979 | Curtiss |
| 4,134,055 | A | | 1/1979 | Akamatsu |
| 4,134,146 | A | | 1/1979 | Stetson |
| 4,149,101 | A | | 4/1979 | Lesokhin et al. |
| 4,152,615 | A | | 5/1979 | Calfo et al. |
| 4,160,193 | A | | 7/1979 | Richmond |
| 4,164,672 | A | | 8/1979 | Flick |
| 4,164,772 | A | | 8/1979 | Hingorani |
| 4,177,397 | A | | 12/1979 | Lill |
| 4,177,418 | A | | 12/1979 | Brueckner et al. |
| 4,184,186 | A | | 1/1980 | Barkan |
| 4,200,817 | A | | 4/1980 | Bratoljic |
| 4,200,818 | A | | 4/1980 | Ruffing et al. |
| 4,206,434 | A | | 6/1980 | Hase |
| 4,207,427 | A | | 6/1980 | Beretta et al. |
| 4,207,482 | A | | 6/1980 | Neumeyer et al. |

4,208,597 A 6/1980 Mulach et al.
4,229,721 A 10/1980 Koloczek et al.
4,238,339 A 12/1980 Khutoretsky et al.
4,239,999 A 12/1980 Vinokurov et al.
4,245,182 A 1/1981 Aotsu et al.
4,246,694 A 1/1981 Raschbichler et al.
4,255,684 A 3/1981 Mischler et al.
4,258,280 A 3/1981 Starcevic
4,262,209 A 4/1981 Berner
4,274,027 A 6/1981 Higuchi et al.
4,281,264 A 7/1981 Keim et al.
4,292,558 A 9/1981 Flick et al.
4,307,311 A 12/1981 Grozinger
4,308,476 A 12/1981 Schuler
4,308,575 A 12/1981 Mase
4,310,966 A 1/1982 Brietenbach
4,314,168 A 2/1982 Breitenbach
4,317,001 A 2/1982 Silver et al.
4,320,645 A 3/1982 Stanley
4,321,426 A 3/1982 Schaeffer
4,321,518 A 3/1982 Akamatsu
4,330,726 A 5/1982 Albright et al.
4,337,922 A 7/1982 Streiff et al.
4,341,989 A 7/1982 Sandberg et al.
4,347,449 A 8/1982 Beau
4,347,454 A 8/1982 Gellert et al.
4,357,542 A 11/1982 Kirschbaum
4,360,748 A 11/1982 Raschbichler et al.
4,361,723 A 11/1982 Hvizd, Jr. et al.
4,363,612 A 12/1982 Meyers
4,365,178 A 12/1982 Lexz
4,367,425 A 1/1983 Mendelsohn et al.
4,367,890 A 1/1983 Spirk
4,368,418 A 1/1983 Demello et al.
4,369,389 A 1/1983 Lambrecht
4,371,745 A 2/1983 Sakashita
4,384,944 A 5/1983 Silver et al.
4,387,316 A 6/1983 Katsekas
4,401,920 A 8/1983 Taylor et al.
4,403,163 A 9/1983 Rarmerding et al.
4,404,486 A 9/1983 Keim et al.
4,411,710 A 10/1983 Mochizuki et al.
4,421,284 A 12/1983 Pan
4,425,521 A 1/1984 Rosenberry, Jr. et al.
4,426,771 A 1/1984 Wang et al.
4,429,244 A 1/1984 Nikiten et al.
4,431,960 A 2/1984 Zucker
4,432,029 A 2/1984 Lundqvist
4,437,464 A 3/1984 Crow
4,443,725 A 4/1984 Derderian et al.
4,445,668 A * 5/1984 Sauber ..... 254/287
4,447,013 A * 5/1984 Sandered et al. ..... 242/54
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,484,106 A 11/1984 Taylor et al.
4,488,079 A 12/1984 Dailey et al.
4,490,651 A 12/1984 Taylor et al.
4,503,284 A 3/1985 Minnick et al.
4,508,251 A * 4/1985 Harada et al. ..... 226/25
4,510,077 A 4/1985 Elton
4,517,471 A 5/1985 Sachs
4,520,287 A 5/1985 Wang et al.
4,523,249 A 6/1985 Arimoto
4,538,131 A 8/1985 Baier et al.
4,546,210 A 10/1985 Akiba et al.
4,551,780 A 11/1985 Canay
4,557,038 A 12/1985 Wcislo et al.
4,560,896 A 12/1985 Vogt et al.
4,565,929 A 1/1986 Baskin et al.
4,571,453 A 2/1986 Takaoka et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,615,778 A 10/1986 Elton
4,618,795 A 10/1986 Cooper et al.
4,619,040 A 10/1986 Wang et al.
4,622,116 A 11/1986 Elton et al.
4,633,109 A 12/1986 Feigel
4,650,924 A 3/1987 Kauffman et al.
4,652,963 A 3/1987 Fahlen
4,656,316 A 4/1987 Meltsch
4,656,379 A 4/1987 McCarty
4,677,328 A 6/1987 Kumakura
4,687,882 A 8/1987 Stone et al.
4,692,731 A 9/1987 Osinga
4,723,083 A 2/1988 Elton
4,723,104 A 2/1988 Rohatyn
4,724,345 A 2/1988 Elton et al.
4,732,412 A 3/1988 van der Linden et al.
4,737,704 A 4/1988 Kalinnikov et al.
4,745,314 A 5/1988 Nakano
4,761,602 A 8/1988 Leibovich
4,766,365 A 8/1988 Bolduc et al.
4,771,168 A 9/1988 Gundersen et al.
4,785,138 A 11/1988 Brietenbach et al.
4,795,933 A 1/1989 Sakai
4,809,917 A * 3/1989 Tsuchiya ..... 242/7.06
4,827,172 A 5/1989 Kobayashi
4,845,308 A 7/1989 Womack, Jr. et al.
4,847,747 A 7/1989 Abbondanti
4,853,565 A 8/1989 Elton et al.
4,859,810 A 8/1989 Cloetens et al.
4,859,989 A 8/1989 McPherson
4,860,430 A 8/1989 Raschbichler et al.
4,864,266 A 9/1989 Feather et al.
4,883,230 A 11/1989 Lindstrom
4,890,040 A 12/1989 Gundersen
4,894,284 A 1/1990 Yamanouchi et al.
4,914,386 A 4/1990 Zocholl
4,918,347 A 4/1990 Takaba
4,918,835 A 4/1990 Wcislo et al.
4,924,342 A 5/1990 Lee
4,926,079 A 5/1990 Niemela et al.
4,942,326 A 7/1990 Butler, III et al.
4,949,001 A 8/1990 Campbell
4,982,147 A 1/1991 Lauw
4,994,952 A 2/1991 Silva et al.
4,997,995 A 3/1991 Simmons et al.
5,012,125 A 4/1991 Conway
5,030,813 A 7/1991 Stanisz
5,036,165 A 7/1991 Elton et al.
5,036,238 A 7/1991 Tajima
5,066,881 A 11/1991 Elton et al.
5,067,046 A 11/1991 Elton et al.
5,083,360 A 1/1992 Valencic et al.
5,086,246 A 2/1992 Dymond et al.
5,091,609 A 2/1992 Swada et al.
5,094,703 A 3/1992 Takaoka et al.
5,095,175 A 3/1992 Yoshida et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.
5,168,662 A 12/1992 Nakamura et al.

| | | | | |
|---|---|---|---|---|
| 5,171,941 | A | | 12/1992 | Shimizu et al. |
| 5,182,537 | A | | 1/1993 | Thuis |
| 5,187,428 | A | | 2/1993 | Hutchison et al. |
| 5,231,249 | A | | 7/1993 | Kimura et al. |
| 5,235,488 | A | | 8/1993 | Koch |
| 5,246,783 | A | | 9/1993 | Spenadel et al. |
| 5,264,778 | A | | 11/1993 | Kimmel et al. |
| 5,287,262 | A | | 2/1994 | Klein |
| 5,304,883 | A | | 4/1994 | Denk |
| 5,305,961 | A | | 4/1994 | Errard et al. |
| 5,321,308 | A | | 6/1994 | Johncock |
| 5,323,330 | A | | 6/1994 | Asplund et al. |
| 5,325,008 | A | | 6/1994 | Grant |
| 5,325,259 | A | | 6/1994 | Paulsson |
| 5,327,637 | A | | 7/1994 | Britenbach et al. |
| 5,341,281 | A | | 8/1994 | Skibinski |
| 5,343,139 | A | | 8/1994 | Gyugyi et al. |
| 5,355,046 | A | | 10/1994 | Weigelt |
| 5,365,132 | A | | 11/1994 | Hann et al. |
| 5,387,890 | A | | 2/1995 | Estop et al. |
| 5,397,513 | A | | 3/1995 | Steketee, Jr. |
| 5,399,941 | A | | 3/1995 | Grothaus et al. |
| 5,400,005 | A | | 3/1995 | Bobry |
| 5,408,169 | A | | 4/1995 | Jeanneret |
| 5,449,861 | A | | 9/1995 | Fujino et al. |
| 5,452,170 | A | | 9/1995 | Ohde et al. |
| 5,468,916 | A | | 11/1995 | Litenas et al. |
| 5,499,178 | A | | 3/1996 | Mohan |
| 5,500,632 | A | | 3/1996 | Halser, III |
| 5,510,942 | A | | 4/1996 | Bock et al. |
| 5,530,307 | A | | 6/1996 | Horst |
| 5,533,658 | A | | 7/1996 | Benedict et al. |
| 5,534,754 | A | | 7/1996 | Poumey |
| 5,545,853 | A | | 8/1996 | Hildreth |
| 5,550,410 | A | | 8/1996 | Titus |
| 5,583,387 | A | | 12/1996 | Takeuchi et al. |
| 5,587,126 | A | | 12/1996 | Steketee, Jr. |
| 5,598,137 | A | | 1/1997 | Alber et al. |
| 5,601,223 | A | * | 2/1997 | Koch et al. ..... 226/172 |
| 5,607,320 | A | | 3/1997 | Wright |
| 5,612,510 | A | | 3/1997 | Hildreth |
| 5,663,605 | A | | 9/1997 | Evans et al. |
| 5,672,926 | A | | 9/1997 | Brandes et al. |
| 5,689,223 | A | | 11/1997 | Demarmels et al. |
| 5,807,447 | A | | 9/1998 | Forrest |
| 5,834,699 | A | | 11/1998 | Buck et al. |

FOREIGN PATENT DOCUMENTS

| | | |
|---|---|---|
| DE | 336418 | 6/1920 |
| DE | 372390 | 3/1923 |
| DE | 386561 | 12/1923 |
| DE | 387973 | 1/1924 |
| DE | 406371 | 11/1924 |
| DE | 425551 | 2/1926 |
| DE | 426793 | 3/1926 |
| DE | 432169 | 7/1926 |
| DE | 433749 | 9/1926 |
| DE | 435608 | 10/1926 |
| DE | 435609 | 10/1926 |
| DE | 441717 | 3/1927 |
| DE | 443011 | 4/1927 |
| DE | 460124 | 5/1928 |
| DE | 482506 | 9/1929 |
| DE | 501181 | 7/1930 |
| DE | 523047 | 4/1931 |
| DE | 568508 | 1/1933 |
| DE | 572030 | 3/1933 |
| DE | 584639 | 9/1933 |
| DE | 586121 | 10/1933 |
| DE | 604972 | 11/1934 |
| DE | 629301 | 4/1936 |
| DE | 673545 | 3/1939 |
| DE | 719009 | 3/1942 |
| DE | 846583 | 8/1952 |
| DE | 875227 | 4/1953 |
| DE | 975999 | 1/1963 |
| DE | 1465719 | 5/1969 |
| DE | 1807391 | 5/1970 |
| DE | 2050674 | 5/1971 |
| DE | 1638176 | 6/1971 |
| DE | 2155371 | 5/1973 |
| DE | 2400698 | 7/1975 |
| DE | 2520511 | 11/1976 |
| DE | 2656389 | 6/1978 |
| DE | 2721905 | 11/1978 |
| DE | 137164 | 8/1979 |
| DE | 138840 | 11/1979 |
| DE | 2824951 | 12/1979 |
| DE | 2835386 | 2/1980 |
| DE | 2839517 | 3/1980 |
| DE | 2854520 | 6/1980 |
| DE | 3009102 | 9/1980 |
| DE | 2913697 | 10/1980 |
| DE | 2920478 | 12/1980 |
| DE | 3028777 | 3/1981 |
| DE | 2939004 | 4/1981 |
| DE | 3006382 | 8/1981 |
| DE | 3008818 | 9/1981 |
| DE | 209313 | 4/1984 |
| DE | 3305225 | 8/1984 |
| DE | 3309051 | 9/1984 |
| DE | 3441311 | 5/1986 |
| DE | 3543106 | 6/1987 |
| DE | 2917717 | 8/1987 |
| DE | 3612112 | 10/1987 |
| DE | 3726346 | 2/1989 |
| DE | 3925337 | 2/1991 |
| DE | 4023903 | 11/1991 |
| DE | 4022476 | 1/1992 |
| DE | 4233558 | 3/1994 |
| DE | 4402184 | 8/1995 |
| DE | 4409794 | 8/1995 |
| DE | 4412761 | 10/1995 |
| DE | 4420322 | 12/1995 |
| DE | 19620906 | 1/1996 |
| DE | 4438186 | 5/1996 |
| DE | 19020222 | 3/1997 |
| DE | 19547229 | 6/1997 |
| DE | 468827 | 7/1997 |
| EP | 049104 | 4/1982 |
| EP | 0493704 | 4/1982 |
| EP | 0056580 A1 | 7/1982 |
| EP | 078908 | 5/1983 |
| EP | 0120154 | 10/1984 |
| EP | 0130124 | 1/1985 |
| EP | 0142813 | 5/1985 |
| EP | 0155405 | 9/1985 |
| EP | 0102513 | 1/1986 |
| EP | 0174783 | 3/1986 |
| EP | 0185788 | 7/1986 |
| EP | 0277358 | 8/1986 |
| EP | 0234521 | 9/1987 |
| EP | 0244069 | 11/1987 |
| EP | 0246377 | 11/1987 |
| EP | 0265868 | 5/1988 |
| EP | 0274691 | 7/1988 |
| EP | 0280759 | 9/1988 |
| EP | 0282876 | 9/1988 |
| EP | 0309096 | 3/1989 |
| EP | 0314860 | 5/1989 |
| EP | 0316911 | 5/1989 |
| EP | 0317248 | 5/1989 |

| | | | |
|---|---|---|---|
| EP | 0335430 | | 10/1989 |
| EP | 0342554 | | 11/1989 |
| EP | 0221404 | | 5/1990 |
| EP | 0375101 | | 6/1990 |
| EP | 0406437 | | 1/1991 |
| EP | 0439410 | | 7/1991 |
| EP | 0440865 | | 8/1991 |
| EP | 0469155 | A1 | 2/1992 |
| EP | 0490705 | | 6/1992 |
| EP | 0503817 | | 9/1992 |
| EP | 0571155 | | 11/1993 |
| EP | 0620570 | | 10/1994 |
| EP | 0620630 | | 10/1994 |
| EP | 0642027 | | 3/1995 |
| EP | 0671632 | | 9/1995 |
| EP | 0676777 | | 10/1995 |
| EP | 0677915 | | 10/1995 |
| EP | 0684679 | | 11/1995 |
| EP | 0684682 | | 11/1995 |
| EP | 0695019 | | 1/1996 |
| EP | 0732787 | | 9/1996 |
| EP | 0738034 | | 10/1996 |
| EP | 0739087 | A2 | 10/1996 |
| EP | 0740315 | | 10/1996 |
| EP | 0749190 | A2 | 12/1996 |
| EP | 0751605 | | 1/1997 |
| EP | 0739087 | A3 | 3/1997 |
| EP | 0749193 | A3 | 3/1997 |
| EP | 0780926 | | 6/1997 |
| EP | 0802542 | | 10/1997 |
| EP | 0913912 | A1 | 5/1999 |
| FR | 805544 | | 4/1936 |
| FR | 841351 | | 1/1938 |
| FR | 847899 | | 12/1938 |
| FR | 916959 | | 12/1946 |
| FR | 1011924 | | 4/1949 |
| FR | 1126975 | | 3/1955 |
| FR | 1238795 | | 7/1959 |
| FR | 2108171 | | 5/1972 |
| FR | 2251938 | | 6/1975 |
| FR | 2305879 | | 10/1976 |
| FR | 2376542 | | 7/1978 |
| FR | 2467502 | | 4/1981 |
| FR | 2481531 | | 10/1981 |
| FR | 2556146 | | 6/1985 |
| FR | 2594271 | | 8/1987 |
| FR | 2708157 | | 1/1995 |
| GB | 123906 | | 3/1919 |
| GB | 268271 | | 3/1927 |
| GB | 293861 | | 11/1928 |
| GB | 292999 | | 4/1929 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 666883 | | 2/1952 |
| GB | 685416 | | 1/1953 |
| GB | 702892 | | 1/1954 |
| GB | 715226 | | 9/1954 |
| GB | 723457 | | 2/1955 |
| GB | 739962 | | 11/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 5/1965 |
| GB | 1024583 | | 3/1966 |
| GB | 1053337 | | 12/1966 |
| GB | 1059123 | | 2/1967 |
| GB | 1103098 | | 2/1968 |
| GB | 1103099 | | 2/1968 |
| GB | 1117401 | | 6/1968 |
| GB | 1135242 | | 12/1968 |
| GB | 1147049 | | 4/1969 |
| GB | 1157885 | | 7/1969 |
| GB | 1174659 | | 12/1969 |
| GB | 1236082 | | 6/1971 |
| GB | 1268770 | | 3/1972 |
| GB | 1319257 | | 6/1973 |
| GB | 1322433 | | 7/1973 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 2000625 | | 1/1979 |
| GB | 1548633 | | 7/1979 |
| GB | 2046142 | | 11/1979 |
| GB | 2022327 | | 12/1979 |
| GB | 2025150 | | 1/1980 |
| GB | 2034101 | | 5/1980 |
| GB | 1574796 | | 9/1980 |
| GB | 2070341 | | 9/1981 |
| GB | 2070470 | | 9/1981 |
| GB | 2071433 | | 9/1981 |
| GB | 2081523 | | 2/1982 |
| GB | 2099635 | | 12/1982 |
| GB | 2105925 | | 3/1983 |
| GB | 2106306 | | 4/1983 |
| GB | 2106721 | | 4/1983 |
| GB | 2136214 | | 9/1984 |
| GB | 2140195 | | 11/1984 |
| GB | 2150153 | | 6/1985 |
| GB | 2268337 | | 1/1994 |
| GB | 2273819 | | 6/1994 |
| GB | 2283133 | | 4/1995 |
| GB | 2289992 | | 12/1995 |
| GB | 2308490 | | 6/1997 |
| GB | 2332557 | | 6/1999 |
| HU | 175494 | | 11/1981 |
| JP | 60206121 | | 3/1959 |
| JP | 57043529 | | 8/1980 |
| JP | 57126117 | | 5/1982 |
| JP | 59076156 | | 10/1982 |
| JP | 59159642 | | 2/1983 |
| JP | 6264964 | | 9/1985 |
| JP | 1129737 | | 5/1989 |
| JP | 62320631 | | 6/1989 |
| JP | 2017474 | | 1/1990 |
| JP | 3245748 | | 2/1990 |
| JP | 4179107 | | 11/1990 |
| JP | 318253 | | 1/1991 |
| JP | 424909 | | 1/1992 |
| JP | 5290947 | | 4/1992 |
| JP | 6196343 | | 12/1992 |
| JP | 6233442 | | 2/1993 |
| JP | 6325629 | | 5/1993 |
| JP | 7057951 | | 8/1993 |
| JP | 7264789 | | 3/1994 |
| JP | 8167332 | | 12/1994 |
| JP | 7161270 | | 6/1995 |

| | | |
|---|---|---|
| JP | 8264039 | 11/1995 |
| JP | 9200989 | 1/1996 |
| JP | 8036952 | 2/1996 |
| JP | 8167360 | 6/1996 |
| LU | 67199 | 3/1972 |
| SE | 90308 | 9/1937 |
| SE | 305899 | 11/1968 |
| SE | 255156 | 2/1969 |
| SE | 341428 | 12/1971 |
| SE | 453236 | 1/1982 |
| SE | 457792 | 6/1987 |
| SE | 502417 | 12/1993 |
| SU | 792302 | 1/1971 |
| SU | 425268 | 9/1974 |
| SU | 1019553 | 1/1980 |
| SU | 694939 | 1/1982 |
| SU | 955369 | 8/1983 |
| SU | 1511810 | 5/1987 |
| WO | WO8202617 | 8/1982 |
| WO | WO8502302 | 5/1985 |
| WO | WO9011389 | 10/1990 |
| WO | WO9012409 | 10/1990 |
| WO | 90/00279 | 11/1990 |
| WO | WO9101059 | 1/1991 |
| WO | WO9101585 | 2/1991 |
| WO | WO9107807 | 3/1991 |
| WO | 91/00077 | 4/1991 |
| WO | WO9109442 | 6/1991 |
| WO | WO 91/11841 | 8/1991 |
| WO | WO8115862 | 10/1991 |
| WO | WO 91/15755 | 10/1991 |
| WO | WO9201328 | 1/1992 |
| WO | WO9203870 | 3/1992 |
| WO | WO9321681 | 10/1993 |
| WO | WO9406194 | 3/1994 |
| WO | WO9518058 | 7/1995 |
| WO | WO9522153 | 8/1995 |
| WO | WO9524049 | 9/1995 |
| WO | WO9622606 | 7/1996 |
| WO | WO9622607 | 7/1996 |
| WO | 96/00010 | 10/1996 |
| WO | WO9630144 | 10/1996 |
| WO | WO9710640 | 3/1997 |
| WO | WO9711831 | 4/1997 |
| WO | WO9716881 | 5/1997 |
| WO | WO 97/29494 | 8/1997 |
| WO | WO9745288 | 12/1997 |
| WO | WO9745847 | 12/1997 |
| WO | WO9745848 | 12/1997 |
| WO | WO9745906 | 12/1997 |
| WO | WO9745907 | 12/1997 |
| WO | WO9745912 | 12/1997 |
| WO | WO9745915 | 12/1997 |
| WO | WO9745916 | 12/1997 |
| WO | WO9745918 | 12/1997 |
| WO | WO9745919 | 12/1997 |
| WO | WO9745920 | 12/1997 |
| WO | WO9745921 | 12/1997 |
| WO | WO9745922 | 12/1997 |
| WO | WO9745923 | 12/1997 |
| WO | WO9745924 | 12/1997 |
| WO | WO9745925 | 12/1997 |
| WO | WO9745926 | 12/1997 |
| WO | WO9745927 | 12/1997 |
| WO | WO9745928 | 12/1997 |
| WO | WO9745929 | 12/1997 |
| WO | WO9745930 | 12/1997 |
| WO | WO9745931 | 12/1997 |
| WO | WO9745932 | 12/1997 |
| WO | WO9745933 | 12/1997 |
| WO | WO9745934 | 12/1997 |
| WO | WO9745935 | 12/1997 |
| WO | WO9745936 | 12/1997 |
| WO | WO9745937 | 12/1997 |
| WO | WO9745938 | 12/1997 |
| WO | WO9745939 | 12/1997 |
| WO | WO9747067 | 12/1997 |
| WO | WO9749514 | 12/1997 |
| WO | WO9820595 | 5/1998 |
| WO | WO9820596 | 5/1998 |
| WO | WO9820597 | 5/1998 |
| WO | WO 98/20598 | 5/1998 |
| WO | WO9820600 | 5/1998 |
| WO | WO 98/20602 | 5/1998 |
| WO | WO9821385 | 5/1998 |
| WO | 98/00468 | 6/1998 |
| WO | WO9827634 | 6/1998 |
| WO | WO9827635 | 6/1998 |
| WO | WO9827636 | 6/1998 |
| WO | WO9829927 | 7/1998 |
| WO | WO9829928 | 7/1998 |
| WO | WO9829929 | 7/1998 |
| WO | WO9829930 | 7/1998 |
| WO | WO9829931 | 7/1998 |
| WO | WO9829932 | 7/1998 |
| WO | WO9833731 | 8/1998 |
| WO | WO9833736 | 8/1998 |
| WO | WO9833737 | 8/1998 |
| WO | WO9834238 | 8/1998 |
| WO | WO 98/34239 | 8/1998 |
| WO | WO9834240 | 8/1998 |
| WO | WO9834241 | 8/1998 |
| WO | WO9834242 | 8/1998 |
| WO | WO9834243 | 8/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834315 | 8/1998 |
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO9834331 | 8/1998 |
| WO | WO 98/40627 | 9/1998 |
| WO | WO 98/43336 | 10/1998 |
| WO | WO9917309 | 4/1999 |
| WO | WO9917311 | 4/1999 |
| WO | WO9917312 | 4/1999 |
| WO | WO9917313 | 4/1999 |
| WO | WO9917314 | 4/1999 |
| WO | WO9917315 | 4/1999 |
| WO | WO9917316 | 4/1999 |
| WO | WO9917422 | 4/1999 |
| WO | WO9917424 | 4/1999 |
| WO | WO9917425 | 4/1999 |
| WO | WO9917426 | 4/1999 |
| WO | WO9917427 | 4/1999 |
| WO | WO9917428 | 4/1999 |
| WO | WO9917429 | 4/1999 |
| WO | WO9917432 | 4/1999 |
| WO | WO9917433 | 4/1999 |

| | | |
|---|---|---|
| WO | WO9919963 | 4/1999 |
| WO | WO9919969 | 4/1999 |
| WO | WO9919970 | 4/1999 |
| WO | 98/02148 | 6/1999 |
| WO | WO9927546 | 6/1999 |
| WO | WO9928919 | 6/1999 |
| WO | WO9928921 | 6/1999 |
| WO | WO 99/28922 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |
| WO | WO9928931 | 6/1999 |
| WO | WO9928934 | 6/1999 |
| WO | WO9928994 | 6/1999 |
| WO | WO9929005 | 6/1999 |
| WO | WO 99/29005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO 99/29023 | 6/1999 |
| WO | WO9929024 | 6/1999 |
| WO | WO 99/29025 | 6/1999 |
| WO | WO9929026 | 6/1999 |
| WO | WO9929029 | 6/1999 |
| WO | WO9929034 | 6/1999 |

OTHER PUBLICATIONS

Analysis of faulted Power Systems; P Anderson, Iowa State University Press / Ames, Iowa, 1973, pp. 255–257.

36–Kv. Generators Arise from Insulation Research; P. Sidler; *Electrical World* Oct. 15, 1932, pp. 524.

Oil Water cooled 300 MW turbine generator;L.P. Gnedin et al;*Elektrotechnika*, 1970, pp. 6–8.

J&P Transformer Book 11$^{th}$ Edition;A. C. Franklin et al; owned by Butterworth–Heinemann Ltd, Oxford Printed by Hartnolls Ltd in Great Britain 1983, pp. 29–67.

Transformerboard; H.P. Moser et al; 1979, pp. 1–19.

The Skagerrak transmission—the world's longest HVDC submarine cable link; L. Haglof et al of ASEA; ASEA Journal vol. 53, No. 1–2, 1980, pp. 3–12.

Direct Connection of Generators to HVDC Converters: Main Characteristics and Comparative Advantages; J. Arrillaga et al; *Electra* No. 149, Aug. 1993, pp. 19–37.

Our flexible friend article; M. Judge; *New Scientist*, May 10, 1997, pp. 44–48.

In–Service Performance of HVDC Converter transformers and oil–cooled smoothing reactors; G.L. Desilets et al; *Electra* No. 155, Aug. 1994, pp. 7–29.

Transformateurs a courant continu haute tension–examen des specifications; A. Lindroth et al; *Electra* No. 141, Apr. 1992, pp. 34–39.

Development of a Termination for the 77 kV–Class High Tc Superconducting Power Cable; T. Shimonosono et al; IEEE Power Delivery, vol. 12, No. 1, Jan. 1997, pp. 33–38.

Verification of Limiter Performance in Modern Excitation Control Systems; G. K. Girgis et al; IEEE Energy Conservation, vol. 10, No. 3, Sep. 1995, pp. 538–542.

A High Initial response Brushless Excitation System; T. L. Dillman et al; IEEE Power Generation Winter Meeting Proceedings, Jan. 31, 1971, pp. 2089–2094.

Design, manufacturing and cold test of a superconducting coil and its cryostat for SMES applications; A. Bautista et al; IEEE Applied Superconductivity, vol. 7, No. 2, Jun. 1997, pp. 853–856.

Quench Protection and Stagnant Normal Zones in a Large Cryostable SMES; Y. Lvovsky et al; IEEE Applied Superconductivity, vol. 7, No. 2, Jun. 1997, pp. 857–860.

Design and Construction of the 4 Tesla Background Coil for the Navy SMES Cable Test Apparatus; D.W. Scherbarth et al; IEEE Appliel Superconductivity, vol. 7, No. 2, Jun. 1997, pp. 840–843.

High Speed Synchronous Motors Adjustable Speed Drives; ASEA Generation Pamphlet OG 135–101 E, Jan. 1985, pp. 1–4.

Billig burk motar overtonen; A. Felldin; *ERA* (TEKNIK) Aug. 1994, pp. 26–28.

400–kV XLPE cable system passes CIGRE test; ABB Article; ABB Review Sep. 1995, p. 38.

FREQSYN—a new drive system for high power applications;J–A. Bergman et al; ASEA Journal 59, Apr. 1986, pp. 16–19.

Canadians Create Conductive Concrete; J. Beaudoin et al; *Science*, vol. 276, May 23, 1997, pp. 1201.

Fully Water–Cooled 190 MVA Generators in the Tonstad Hydroelectric Power Station; E. Ostby et al; BBC Review Aug. 1969, pp. 380–385.

Relocatable static var compensators help control unbundled power flows; R. C. Knight et al; *Transmission & Distribution*, Dec. 1996, pp. 49–54.

Investigation and Use of Asynchronized Machines in Power Systems*; N.I. Blotskii et al; *Elektrichestvo*, No. 12, 1–6, 1985, pp. 90–99.

Variable–speed switched reluctance motors; P.J. Lawrenson et al; IEE proc, vol. 127, Pt.B, No. 4, Jul. 1980, pp. 253–265.

Das Einphasenwechselstromsystem hoherer Frequenz; J.G. Heft, Elektrische Bahnen eb; Dec. 1987, pp. 388–389.

Power Transmission by Direct Current;E. Uhlmann;ISBN 3–540–07122–9 Springer–Verlag, Berlin/Heidelberg/New York; 1975, pp. 327–328.

Elektriska Maskiner; F. Gustavson; Institute for Elkreafteknilk, KTH; Stockholm, 1996, pp. 3–6–3–12.

Die Wechselstromtechnik; A. Cour' Springer Verlag, Germany; 1936, pp. 586–598.

Insulation systems for superconducting transmission cables; O. Toennesen; Nordic Insulation Symposium, Bergen, 1996, pp. 425–432.

MPTC: An economical alternative to universal power flow controllers;N. Mohan; EPE 1997, Trondheim, pp. 3.1027–3.1030.

Lexikon der Technik; Luger; Band 2, Grundlagen der Elektrotechnik und Kerntechnik, 1960, p. 395.

Das Handbuch der Lokomotiven (hungarian locomotive V40 1'D'); B. Hollingsworth et al; Pawlak Verlagsgesellschaft; 1933, pp. 254–255.

Synchronous machines with single or double 3–phase star–connected winding fed by 12–pulse load commutated inverter. Simulation of operational behaviour; C. Ivarson et al; ICEM 1994, International Conference on electrical machines, vol. 1, pp. 267–272.
Elkrafthandboken, Elmaskiner; A. Rejminger; Elkrafthandboken, Elmaskiner 1996, 15–20.
Power Electronics—in Theory and Practice; K. Thorborg; ISBN 0–86238–341–2, 1993, pp. 1–13.
Regulating transformers in power systems– new concepts and applications; E. Wirth et al; ABB Review Apr. 1997, pp. 12–20.
Tranforming transformers; S Mehta et al; *IEEE Spectrum*, Jul. 1997, pp. 43–49.
A study of equipment sizes and constraints for a unified power flow controller; J. Bian et al; IEEE Transactions on Power Delivery, vol. 12, No. 3, Jul. 1997, pp. 1385–1391.
Industrial High Voltage; F.H. Kreuger; *Industrial High Voltage* 1991 vol. I, pp. 113–117.
Hochspannungstechnik; A. Küchler; Hochspannungstechnik, VDI Verlag 1996, pp. 365–366, ISBN 3–18–401530–0 or 3–540–62070–2.
High Voltage Engineering; N.S. Naidu; High Voltage Engineering, second edition 1995 ISBN 0–07–462286–2, Chapter 5, pp. 91–98.
Performance Characteristics of a Wide Range Induction Type Frequency Converter; G.A. Ghoneem; Ieema Journal, Sep. 1995, pp. 21–34.
International Electrotechnical Vocabulary, Chapter 551 Power Electronics;unknown author; International Electrotechnical Vocabulary Chapter 551: Power Electronics Bureau Central de la Commission Electrotechnique Internationale, Geneve; 1982, pp. 1–65.
Design and manufacture of a large superconducting homopolar motor; A.D. Appleton; IEEE Transactions on Magnetics, vol. 19,No. 3, Part 2, May 1983, pp. 1048–1050.
Application of high temperature superconductivy to electric motor design; J.S. Edmonds et al; IEEE Transactions on Energy Conversion Jun. 1992, No. 2, pp. 322–329.
Power Electronics and Variable Frequency Drives; B. Bimal; IEEE industrial Electronics—Technology and Applications, 1996, p. 356.
Properties of High Plymer Cement Mortar; M. Tamai et al; *Science & Technology in Japan*, No. 63; 1977, pp. 6–14.
Weatherability of Polymer–Modified Mortars after Ten–Year Outdoor Exposure in Koriyama and Sapporo; Y. Ohama et al; *Science & Technology in Japan No. 63*; 1977, pp. 26–31.
SMC Powders Open New Magnetic Applications; M. Persson (Editor); *SMC Update*, vol. 1, No. 1, Apr. 1997.
Characteristics of a laser triggered spark gap using air, Ar, CH4,H2, He, N2, SF6 and Xe; W.D. Kimura et al; Journal of Applied Physics, vol. 63, No. 6, Mar. 15, 1988, pp. 1882–1888.
Low–intensy laser–triggering of rail–gaps with magnesium–aerosol switching–gases; W. Frey; 11th International Pulse Power Conference, 1997, Baltimore, USA Digest of Technical Papers, pp. 322–327.
Shipboard Electrical Insulation; G. L. Moses, 1951, pp. 2&3.
ABB Elkrafthandbok; ABB AB; 1988 ; pp. 274–276.
Elkraft teknisk Handbook, 2 Elmaskiner; A. Alfredsson et al; 1988, pp. 121–123.
High Voltage Cables in a New Class of Generators Powerformer; M. Leijon et al; Jun. 14, 1999; pp. 1–8.
Ohne Tranformator direkt ins Netz; Owman et al, ABB, AB; Feb. 8, 1999; pp. 48–51.
Submersible Motors and Wet–Rotor Motors for Centrifugal Pumps Submerged in the Fluid Handled; K. Bienick, KSB; Feb. 25, 1988; pp. 9–17.
High Voltage Generators; G. Beschastnov et al; 1977; vol. 48. No. 6 pp. 1–7.
Eine neue Type von Unterwassermotoren; Electrotechnik und Maschinenbam, 49; Aug. 1931; pp. 2–3.
Problems in design of the 110–5OokV high–voltage generators; Nikiti et al; World Electrotechnical Congress; 6/21–27/77; Section 1. Paper #18.
Manufacture and Testing of Roebel bars; P. Marti et al; 1960, Pub.86, vol. 8, pp. 25–31.
Hydroalternators of 110 to 220 kV Elektrotechn. Obz., vol. 64, No. 3, pp. 132–136 Mar. 1975; A. Abramov.
Design Concepts for an Amorphous Metal Distribution Transformer; E. Boyd et al; IEEE 11/84.
Neue Wege zum Bau zweipoliger Turbogeneratoren bis 2 GVA, 60kV Elektrotechnik und Maschinenbau Wien Janner 1972, Heft 1, Seite 1–11; G. Aichholzer.
Optimizing designs of water–resistant magnet wire; V. Kuzenev et al; Elektrotekhnika, vol. 59, No. 12, pp. 35–40, 1988.
Zur Entwicklung der Tauchpumpenmotoren; A. Schanz; KSB, pp. 19–24.
Direct Generation of alternating current at high voltages; R. Parsons; IEEE Journal, vol. 67 #393, Jan. 15, 1929; pp. 1065–1080.
Stopfbachslose Umwalzpumpen– ein wichtiges Element im modernen Kraftwerkbau; H. Holz, KSB 1, pp. 13–19, 1960.
Zur Geschichte der Brown Boveri–Synchron–Maschinen; Vierzig Jahre Generatorbau; Jan.–Feb. 1931 pp. 15–39.
Technik und Anwendung moderner Tauchpumpen; A. Heumann; 1987.
High capacity synchronous generator having no tooth stator; V.S. Kildishev et al; No. 1, 1977 pp. 11–16.*
Der Asynchronmotor als Antrieb stopfbcichsloser Pumpen; E. Picmaus; Eletrotechnik und Maschinenbay No. 78, pp. 153–155, 1961.*
Low core loss rotating flux transformer; R. F. Krause, et al; American Institute Physics J.Appl.Phys vol 64 #10 Nov. 1988, pp. 5376–5378.*
An EHV bulk Power transmission line Made with Low Loss XLPE Cable;Ichihara et al; 8/92; pp. 3–6.*
Underground Transmission Systems Reference Book; 1992;pp. 16–19; pp. 36–45; pp. 67–81.*
Power System Stability and Control; P. Kundur, 1994; pp. 23–25;p. 767.*
Six phase Synchronous Machine with AC and DC Stator Connections, Part II:Harmonic Studies and a proposed Uninterruptible Power Supply Scheme; R. Schiferl et al.; Aug. 1983 pp. 2694–2701.*
Six phase Synchronous Machine with AC and DC Stator Connections, Part 1: Equivalent circuit representation and Steady–State Analysis; R. Schiferl et al; Aug. 1983; pp. 2685–2693.*
Reactive Power Compensation; T. Petersson; 1993; pp. 1–23.*
Permanent Magnet Machines; K. Binns; 1987; pp. 9–1 through 9–26.*

Hochspannungsaniagen for Wechselstrom; 97. Hochspannungsaufgaben an Generatoren und Motoren; Roth et al; 1938; pp. 452–455.*
Hochspannungsanlagen for Wechselstrom; 97. Hochspannungsaufgaben an Generatoren und Motoren; Roth et al; Spring 1959, pp. 30–33.*
Neue Lbsungswege zum Entwurf grosser Turbogeneratoren bis 2GVA, 60kV; G. Aicholzer; Sep. 1974, pp. 249–255.*
Advanced Turbine–generators– an assessment; A. Appleton, et al; International Conf. Proceedings, Lg HV Elec. Sys. Paris, FR, Aug.–Sep. 1976, vol. I, Section 11–02, pp. 1–9.*
Fully slotless turbogenerators; E. Spooner; Proc., IEEE vol. 120 #12, Dec. 1973.*
Toroidal winding geometry for high voltage superconducting alternators; J. Kirtley et al; MIT—Elec. Power Sys. Engrg. Lab for IEEE PES;Feb. 1974.*
High–Voltage Stator Winding Development; D. Albright et al; Proj. Report EL339, Project 1716, Apr. 1984.*
Powerformer™: A giant step in power plant engineering; Owman et al; CIGRE 1998, paper 11:1.1.*
Thin Type DC/DC Converter using a coreless wire transformer; K. Onda et al; Proc. IEEE Power Electronics Spec. Conf.; Jun. 1994, pp. 330–334.*
Development of extruded polymer insulated superconducting cable; Jan. 1992.*
Transformer core losses; B. Richardson; Proc. IEEE May 1986, pp. 365–368.*
Cloth–transformer with divided windings and tension annealed amorphous wire; T. Yammamoto et al; IEEE Translation Journal on Magnetics in Japan vol. 4, No. 9 Sep. 1989.*
A study of equipment sizes and constraints for a unified power flow controller; J Bian et al; IEEE 1996.*

* cited by examiner-

COILING DEVICE

BACKGROUND OF THE INVENTION

1. Field of the Invention

The present invention relates to a device for coiling and uncoiling elongated goods, such as wire, cable or the like, onto a drum and comprising a support with driving means for a spreader arm, which is rotatably mounted on the support for coiling and uncoiling the elongated goods onto the stationary drum.

2. Discussion of the Background

Coiling and uncoiling wire, cable and similar elongated goods by means of a coiling device is per se previously known. During coiling by way of such known devices, the coiled goods are torsionally twisted, wherein one turn of coiling causes one turn of twisting. Counter-clockwise coiling causes clockwise twisting, and clockwise coiling causes counter-clockwise twisting. Uncoiling usually takes place in the opposite direction to the coiling. When all the coiled goods have been uncoiled as stated above there is no remaining twist, however, mechanical stress in the goods has resulted.

Owing to frictional resistance in the spreader arm and in the goods, twisting is not linear along the length of the goods but the portion last coiled will be twisted to a much greater extent as compared to a previously coiled portion of the goods.

The non-linearity of the twisting thus arisen during coiling, which causes mechanical stress in the elongated goods, is not acceptable in some situations.

SUMMARY OF THE INVENTION

To solve the problems pointed out above, the device according to the invention has a spreader arm which, at its side facing the goods, presents a gripping arm, arranged to guide the elongated goods substantially in a tangential direction relative to the periphery of the drum.

In a preferred embodiment of the device according to the invention, the gripping arm has a running track in the form of a curved V-profile. Advantageously, the surface of the running track contacting the goods is defined by feeding rollers, which are spherical in shape and which present a rolling resistance near zero to eliminate twisting of the elongated goods during coiling and uncoiling.

In order to provide a uniform layer of the elongated goods coiled onto the drum, the spreader arm is provided with a device for moving the gripping arm, so that the gripping arm moves along the width of the drum in accordance with the coiling or uncoiling of the goods.

For access to the end of the elongated goods for uncoiling, the device according to the invention is provided with a lifting and rotating table so as to make possible 180° rotation of the drum coiled with goods before uncoiling is initiated. The lifting and rotating table is preferably disposed on a carriage, the wheels of which run on rails starting out from the support of the device.

The present invention further relates to a winding machine and an intermediate storage device having a coiling device of the above-mentioned kind and intended for feeding a cable when mounting the cable in the slots of a stator for an electric machine.

The device, the winding machine and the intermediate storage device is especially but not exclusively intended to be applied when mounting high-voltage cable, on a generator where high-voltage cable is used in the windings of the stator, which cable lacks the outer protective covering normally surrounding such cable.

When mounting such a cable in a stator for an electric machine, the cable is required to be completely free or nearly free from twist, i.e. twisting of the cable should be linear relative to the cable length. This implies that one turn of uncoiling from the drum arbitrarily along the length of the cable should be free or nearly free from twist. In particular the invented device is advantageous when used for an rotating electric machine of the type disclosed in WO-97/45919.

The cable is preferably of the kind having an inner core with a plurality of wires, an inner semiconductive layer surrounding the core, an insulating layer surrounding the inner semiconductive layer and an outer semiconductive layer surrounding the insulating layer, preferably with a diameter of about 20 to 200 mm and a conductor area ranging from 80 to 3000 $mm^2$.

BRIEF DESCRIPTION OF THE DRAWINGS

A preferred embodiment of the coiling device according to the present invention will now be described in more detail with reference to the appended drawings, in which.

DESCRIPTION OF THE PREFERRED EMBODIMENTS

Figure 1:
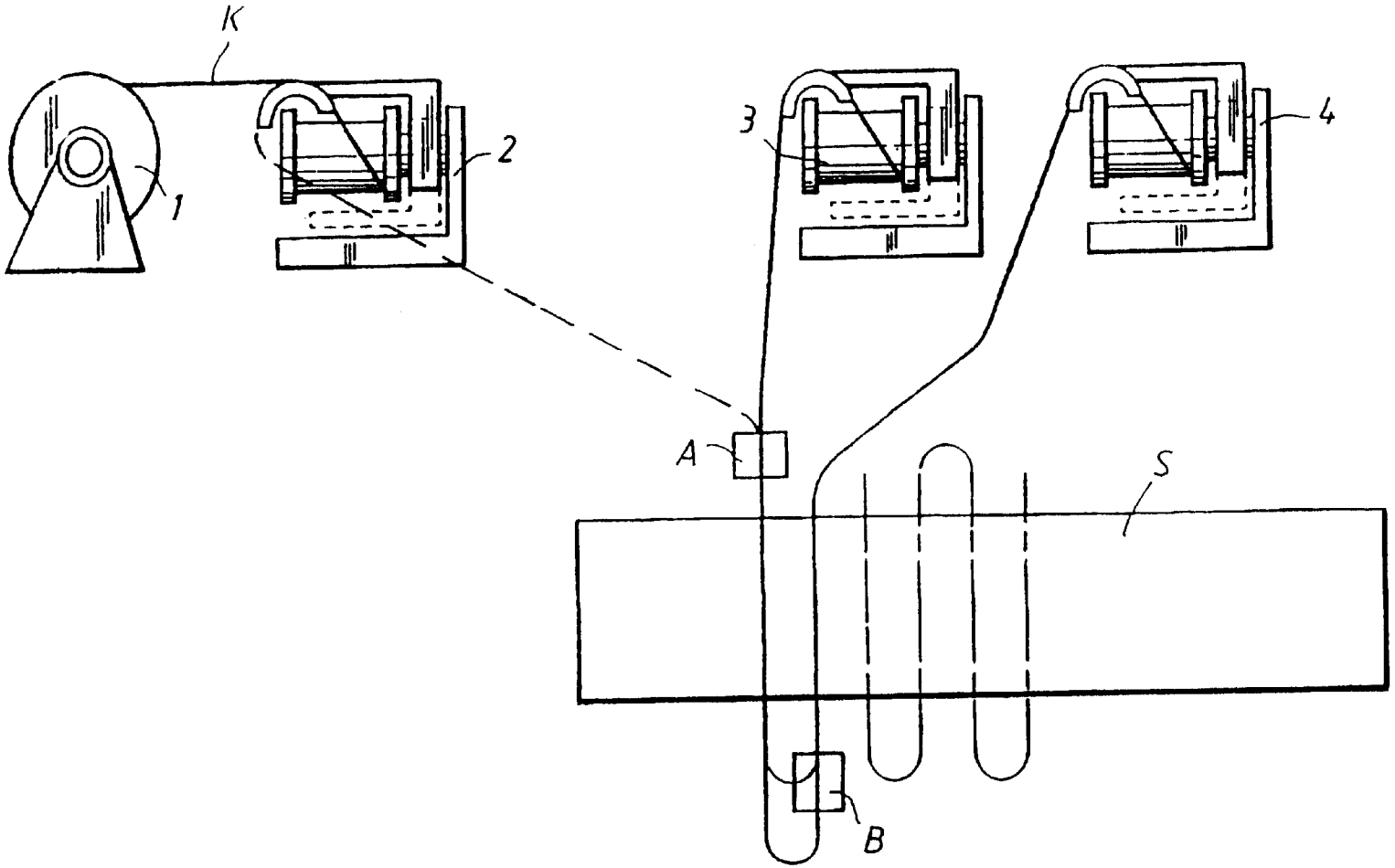
FIG. 1 is a schematic view of equipment for mounting a cable in the stator slots of a stator for an electric generator, which equipment includes coiling devices according to the invention.

When mounting a cable K in a stator S, for example, for an electric generator according to the copending Swedish patent application 9700364-4 entitled "Method and device for mounting cables", equipment such as shown in FIG. 1 is used. This equipment includes a winding machine 2 and two intermediate storage device 3, 4 by way of which the cable K to be mounted in the stator S is distributed to cable feeders A and B. In the exemplified equipment, the winding machine 2 as well as the intermediate storage device 3 and 4 are formed as coiling devices according to the present invention.

Figure 2:
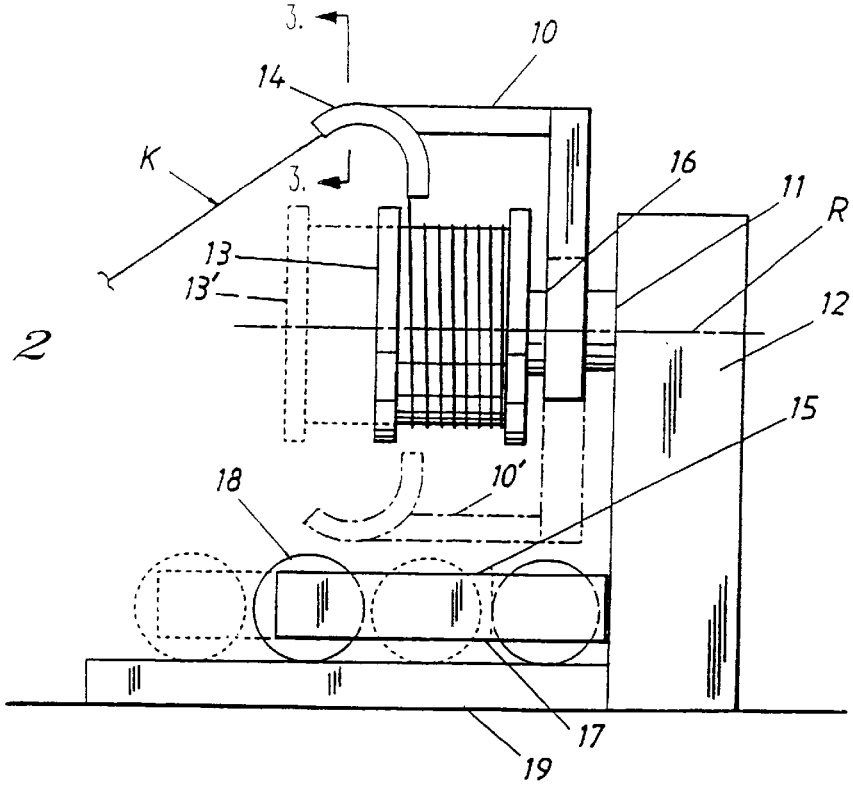
FIG. 2 is a side view illustrating the principle of the coiling device according to the invention.

The principle of the coiling device according to the invention is illustrated in FIG. 2. Thus, a spreader arm 10 is rotatably mounted on an axle 11 and is brought to rotate by a driving device (25, 26 in FIG. 4) disposed in the support 12 of the device. The spreader arm 10 thus rotates around the center of rotation R as indicated by the dash and dot line 10', during coiling and uncoiling of elongated goods K on a stationary drum 13. The spreader arm 10 supports a gripping arm 14, which is drivably mounted along the spreader arm 10 as will be described below with reference to FIG. 4.

The drum 13 is arranged to be disconnected by way of a lifting and rotating table 15 from the coupling 16 of the support 12 so as to be rotated 180°. The lifting and rotating table 15 is disposed on a carriage 17, the wheels 18 of which run on rails 19. In dashed line there is shown the drum 13 advanced by the carriage 17 into position 13' for said rotating by way of the lifting and rotating table 15.

Figure 3:
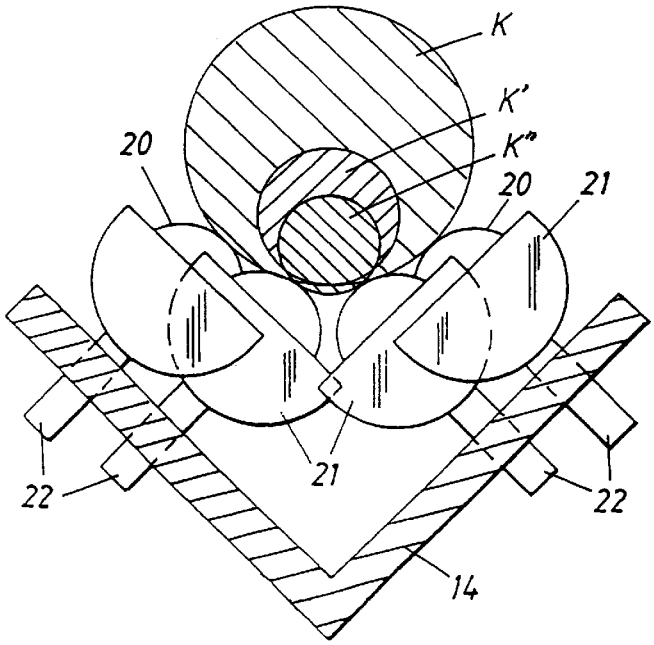
FIG. 3 is a section A—A according to FIG. 2 through the gripping arm associated with the coiling device.

To provide coiling and uncoiling of a cable K without twisting, the gripping arm 14 has a V-shaped cross section within which feeding rollers 20 are mounted in holders 21, as shown in FIG. 3. The feeding rollers 20 are spherical in shape and serve as a running track for the cable K. The spherical rollers 20 have a rolling resistance near zero, implying that twisting of the cable K is eliminated during coiling and uncoiling.

Since each holder 21 is mounted on a spring biased shaft 22 in the V-shaped gripping arm 14, the spherical rollers 20 are automatically adjustable for feeding cables of various dimensions, which is indicated by the cable sizes K, K' and K" in FIG. 3.

Figure 4:
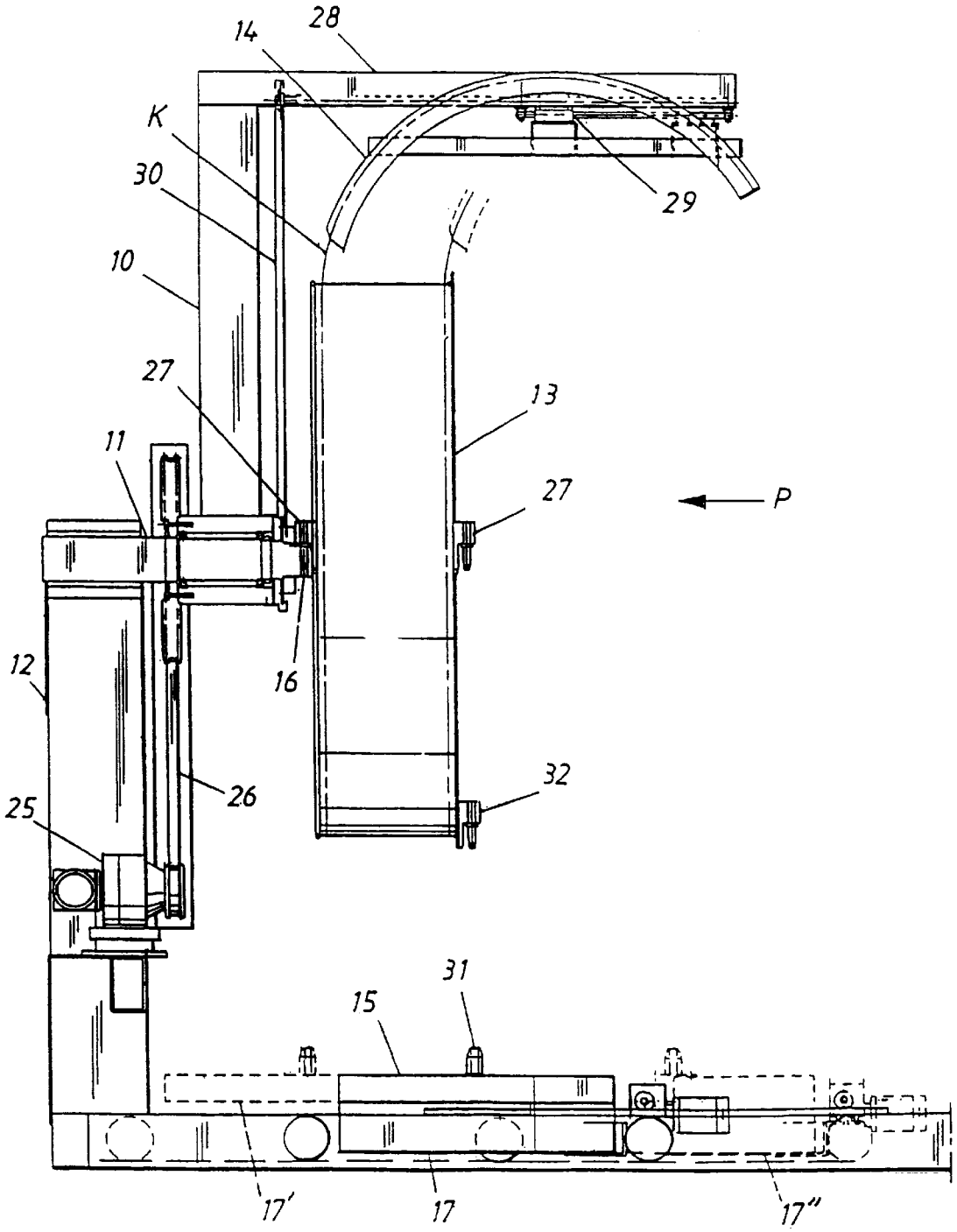
FIG. 4 is a side view of the preferred embodiment of the coiling device according to the invention.
Figure 5:
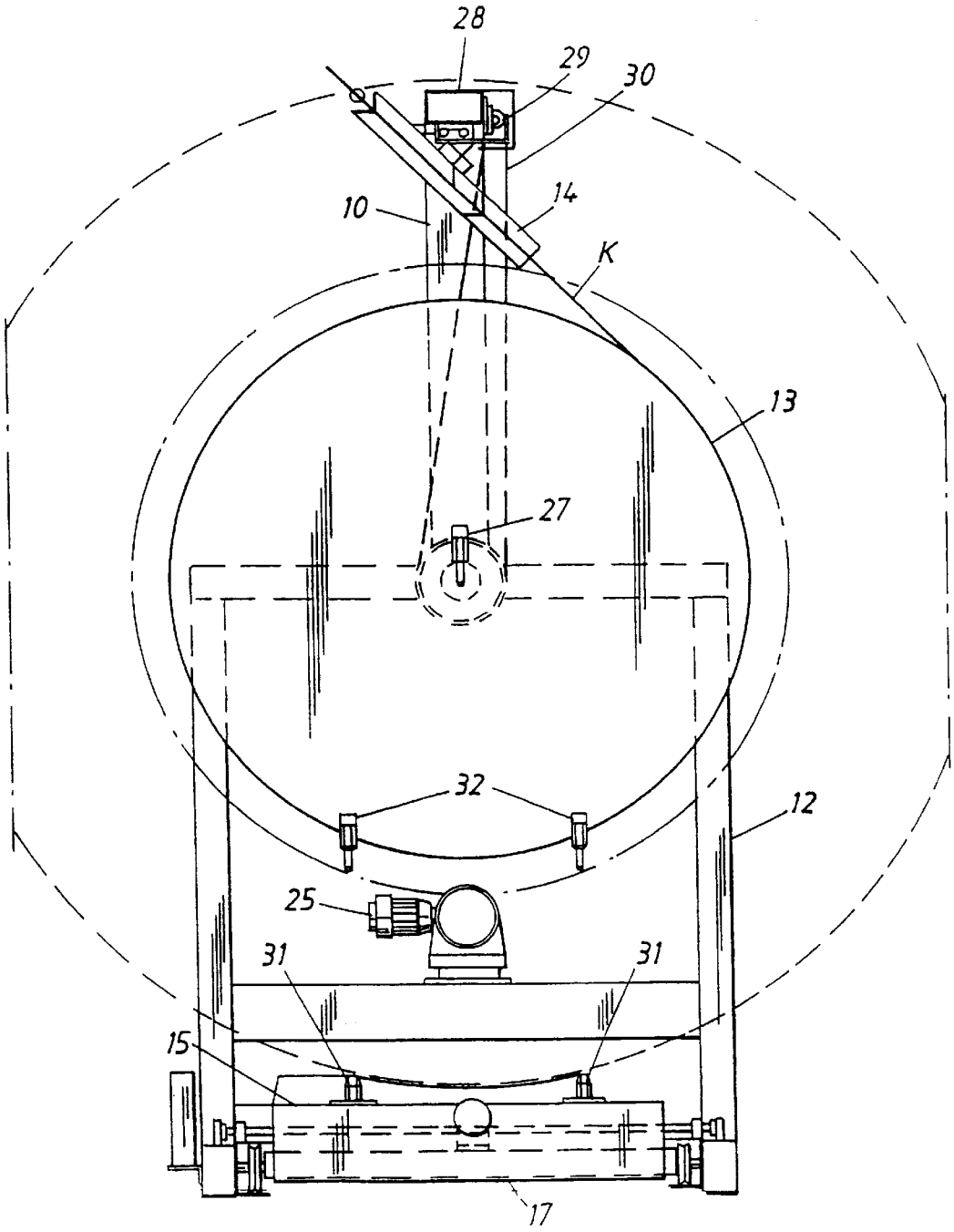
FIG. 5 is front view of the coiling device seen in the direction of the arrow P according to FIG. 4.

In FIGS. 4 and 5 there is depicted a preferred embodiment of the coiling device according to the invention, the support 12 containing a drive motor 25, which by way of a belt or chain drive 26 brings the spreader arm 10 to rotate around the axle 11, which is fixedly mounted in the support 12. At the end of the axle 11 facing outwardly from the support 12 there is provided a coupling mechanism 16 arranged to support the drum 13.

The drum 13 on either front surface presents a tap-formed attachment 27 for alternately cooperating with the coupling mechanism 16 of the support.

The spreader arm 10 has a boom 28, whose under side (facing the drum 13) is formed with a screw 29 for feeding the gripping arm 14. The screw 29 is driven by a belt 30 or chain drive connected to the fixed axle 11, the screw 29 being advanced along the boom 28 in dependence on the rotation of the spreader arm 10. The cable K is hereby coiled and uncoiled along the periphery of the drum 13.

A carriage 17 supports the lifting and rotating table 15, which has an upwardly oriented coupling mechanism 31 for cooperation with yet another couple of tap-formed attachments 32 disposed on one front surface of the drum 13. The lifting and rotating table 15 may include a hydraulic lifting device of pantograph type, but the lifting device may be of other construction also. The carriage 17 is depicted in FIG. 4 in three different positions: a position 17 indicated by continuous lines, an inner end position 17' indicated by dashed lines, and an outer end position 17" also indicated by dashed lines.

As stated above, before uncoiling a coiled drum 13 it is necessary to turn the drum 180° before uncoiling it, so that the cable K coiled is accessible for uncoiling. Turning of the drum 13 is carried out with the carriage 17 in the position indicated by continuous lines, where the lifting device 15 is brought to an elevated position (not shown), so that the upwardly oriented coupling mechanism 31 is brought to cooperate with the additional attachments 32 of the drum 13. The drum 13 is lifted out of engagement between the coupling means 16 and the tap attachment 27.

The drum 13 is now supported by the carriage 17, which is pulled to the outer end position 17" where the lifting and rotating table 15 (and hence the drum 13) is rotated 180°. When this is done, the carriage 17 is pushed to the inner end position 17' and the lifting device 15 is lowered so that the tap attachment 27 of the drum 13 is brought into engagement with the coupling mechanism 16. The drum 13 thus turned is now ready for uncoiling.

The coiling functions will thus be as follows. For coiling, the free end of the cable K is attached to the far end of the drum 13. The other end of the cable K is assumed to be fixed in the slot in a stator frame (S according to FIG. 1). Coiling of the cable K should be carried out such that there will be only one layer of cable on the drum 13. For this purpose, the spreader arm 10 is provided with the device 29 which moves the gripping arm 14 so that only one layer of cable is coiled onto the drum 13. On completion of the coiling, the cable K is removed from the gripping arm 14, the drum is rotated 180° in the horizontal, the free end of the cable K is disconnected and is pulled off the drum 13 via the gripping arm 14 for continued winding of the stator.

While the coiling device according to the invention has been described in conjunction with the preferred embodiment illustrated in the drawings, it will be clear to a person skilled in the art that modifications of various parts may be made without departing from the principle of the invention. The invention therefore shall not be considered limited to what is shown and described with reference to the drawings but is defined solely by the appended claims.

What is claimed is:

1. A device for coiling and uncoiling of elongated goods onto a drum comprising:

a support having a driving device, and a spreader arm configured to be driven by said driving device, said spreader arm being rotatably mounted on the support and when driven by the driving device being configured to coil or uncoil the elongated goods onto the drum, when said drum is stationary, where a coiling operation occurs when said spreader arm is driven by said driving device in one direction, and an uncoiling operation occurring when said driving device drives the spreader arm in an opposite direction, wherein said spreader arm having a gripping arm positioned to face the elongated goods and configured to guide the elongated goods substantially in a tangential direction relative to a periphery of the drum.

2. The device according to claim 1, wherein said gripping arm being formed as a curved V-profile having a running track arranged to accommodate the elongated goods therein, said running track being oriented towards the drum.

3. The device according to claim 2, wherein said gripping arm further comprises feeding rollers mounted therein, said feeding rollers forming the running track of the curved V-profile.

4. The device according to claim 3, wherein the feeding rollers being spherical in shape and having a rolling resistance near zero so as to eliminate twisting of the elongated goods during at least one of the coiling operation and the uncoiling operation.

5. The device according to claim 1, wherein said spreader arm being configured to move the gripping arm so that only one layer of the elongated goods is coiled onto the drum.

6. The device according to claim 5, wherein said spreader arm comprises a screw that is driven through the spreader arm by way of at least one of a belt and chain mounted on the axle fixed in the support.

7. The device according to claim 1, further comprising a lifting and rotating table configured to be positioned under the drum and having a detachable coupling that is coupled to the support when lifting the drum so as to enable a lifting and 180° rotation operation of the drum.

8. The device according to claim 7, wherein:

said lifting and rotating table being disposed on a carriage having wheels, the wheels being arranged to run on rails that originate from the support.

9. The device according to claims 1, wherein said elongated goods being a high-voltage cable.

10. The device according to claim 9, wherein said high-voltage cable having a core with a plurality of wires, an inner semiconductive layer surrounding the core, an insulating layer surrounding the inner semiconductive layer and an outer semiconductive layer surrounding the insulating layer.

11. The device according to claim 9, wherein said high-voltage cable having a diameter in an inclusive range of 20 mm to 200 mm and a conductor area in an inclusive range of 80 $mm^2$ through 3000 $mm^2$.

12. A winding machine configured to feed a cable when mounting the cable in slots of a stator for an electric machine, comprising:

a driving device, and a spreader arm configured to be driven by said driving device, said spreader arm being rotatably mounted on a support and when driven by the driving device being configured to coil or uncoil the elongated goods onto the drum, when said drum is stationary, where a coiling operation occurs when said spreader arm is driven by said driving device in one direction, and an uncoiling operation occurring when said driving device drives the spreader arm in an opposite direction, wherein said spreader arm having a gripping arm positioned to face the elongated goods and configured to guide the elongated goods substantially in a tangential direction relative to a periphery of the drum.

13. An intermediate storage mechanism comprising a coiling device for feeding a cable when mounting the cable in slots of a stator of an electric machine, said coiling device comprising:

a driving device, and a spreader arm configured to be driven by said driving device, said spreader arm being rotatably mounted on a support and when driven by the driving device being configured to coil or uncoil the elongated goods onto the drum, when said drum is stationary, where a coiling operation occurs when said spreader arm is driven by said driving device in one direction, and an uncoiling operation occurring when said driving device drives the spreader arm in an opposite direction, wherein said spreader arm having a gripping arm positioned to face the elongated goods and configured to guide the elongated goods substantially in a tangential direction relative to a periphery of the drum.

14. A device for coiling and uncoiling elongated goods onto a drum, comprising:

means for spreading an elongated cable on a drum; and means for eliminating twist in the elongated goods when said elongated goods being coiled or uncoiled on the drum.

* * * * *